United States Patent [19]

Stern et al.

[11] Patent Number: 4,785,304

[45] Date of Patent: Nov. 15, 1988

[54] PHASE SCAN ANTENNA ARRAY

[75] Inventors: Richard A. Stern, Allenwood; Richard W. Babbitt, Fairhaven; Gerald F. Mikucki, Cinnaminson, all of N.J.

[73] Assignee: The United States of America as represented by the Secretary of the Army, Washington, D.C.

[21] Appl. No.: 932,860

[22] Filed: Nov. 20, 1986

[51] Int. Cl.[4] ..... H01Q 13/10

[52] U.S. Cl. ..... 343/770; 343/771; 343/787; 343/834

[58] Field of Search ..... 343/770, 771, 787, 834, 343/841; 342/371, 372

[56] References Cited

U.S. PATENT DOCUMENTS

| | | | |
|---|---|---|---|
| 3,491,363 | 1/1970 | Young, Jr. | 343/771 |
| 3,855,597 | 12/1974 | Carlise | 343/787 |
| 4,424,517 | 1/1984 | Stern et al. | 343/771 |
| 4,613,869 | 9/1986 | Ajioka et al. | 343/768 |

*Primary Examiner*—William L. Sikes
*Assistant Examiner*—Hoanganh Le
*Attorney, Agent, or Firm*—Sheldon Kanars; Robert A. Maikis

[57] ABSTRACT

A phase scan antenna array for planar radar scanning in a single plane with a pencil-shaped beam is provided comprising a plurality of ferrite rod line source antennas. Each rod antenna has a plurality of beam-emitting slots spaced along one side thereof and is end fed in phase with the other antennas from a single hollow metallic waveguide by means of coupling slots in the waveguide which are spaced apart one wavelength of the radar frequency. The rods are mounted in a two-dimensional columnar array with the beam-emitting slots of each rod aligned in rows with the corresponding slots of the other rods by a mounting member having a plurality of mutually-parallel slots in which the rods are disposed. The walls of the mounting member slots suppress Faraday rotation of the waves in the rods and the bottom of the slots enhance the single beam emitted from the face of the array. The array rods are simultaneously magnetically biased by a plurality of serially-interconnected biasing coils which are helically wound around the mounting member and disposed between the rows of beam-emitting rod slots.

8 Claims, 3 Drawing Sheets

PHASE SCAN ANTENNA ARRAY

STATEMENT OF GOVERNMENT RIGHTS

The invention described herein may be manufactured, used and licensed by or for the Government for Governmental purposes without the payment of any royalties thereon.

BACKGROUND OF THE INVENTION

1. Field of the Invention

This invention relates to antennas and more particularly to a phase scan antenna array for planar radar scanning in a single plane with a substantially pencil-shaped beam.

2. Description of the Prior Art

Radar system antennas are usually designed to be scanned in two, orthogonally-related planes, such as azimuth and elevation, for example. For some applications, however, the antenna need only be scanned in a single plane because other means are available to provide scanning in the orthogonally-related plane. For example, if such an antenna capable of scanning only in a single plane is mounted in a moving vehicle, such as an aircraft, a terminally-guided weapon or a remotely-piloted vehicle, for example, and if the motion or track of the vehicle is along a path which is orthogonally-related to the scanning plane of the antenna, then scanning is effectively provided in two, orthogonally-related planes.

Since such single planes scanning antennas are often mounted in the moving vehicle itself, the size and weight of the antenna and its associated scanning system become very important. For example, when such antennas are used in aircraft, terminally-guided weapons and remotely-piloted vehicles, it is essential that the antenna and its scanning system be as compact as possible and of extremely small size and low weight. Accordingly, antenna systems which are mechanically scanned or driven are usually not feasible for applications of this type because of the complexity and size and weight of the scanning system.

Although electronically "steered" phased array systems have been developed which do not rely upon mechanical scanning or drive mechanisms, they usually require very complex and bulky scanning control arrangements because a large number of phase shifting circuits are required for the individual antenna elements making up the array. Furthermore, the phase scan array systems are expensive to manufacture. Additionally, for some applications, it is desirable that the antenna array be both conformal and frangible. For example, in certain types of terminally-guided weapons, the antenna array must be so mounted in the body of the guided weapon that it is directly in the path of a small projectile or charge which must be fired through the array before impact with the target, so that the array must be easily fractured or broken. For the same application, the limited space available in such guided weapons for mounting the antenna array makes it desirable that a conformal antenna array be employed which can be bent or deformed to some degree to facilitate mounting and placement of the array on or within the weapon.

SUMMARY OF THE INVENTION

It is an object of this invention to provide a phase scan antenna array for planar radar scanning in a single plane which is compact, small in size and low in weight.

It is a further object of this invention to provide a phase scan antenna array for planar radar scanning in a single plane which is of relatively simple construction and is relatively inexpensive to manufacture and maintain.

It is a still further object of this invention to provide a phase scan antenna array for planar radar scanning in a single plane which utilizes only a single scanning control winding to scan the entire array.

It is an additional object of this invention to provide a phase scan antenna array for planar radar scanning in a single plane which is both conformal and frangible.

It is another object of this invention to provide a phase scan antenna array for planar radar scanning in a single plane which is especially suitable for use in millimeter wave radar systems for tanks, aircraft, terminally-guided weapons and remotely-piloted vehicles.

Briefly, the phase scan antenna array of the invention contemplates planar radar scanning in a first plane with a substantially pencil-shaped beam. The array comprises a plurality of ferrite rods each having a longitudinally-extending series of longitudinally-spaced apart perturbations along a first side thereof. The perturbations are adapted to radiate electromagnetic wave energy when the ends of the rods are coupled to a source of millimeter wave energy. The number of perturbations in the series of perturbations is large enough to produce a substantailly pencil-shaped antenna beam in the first plane and the number of rods is large enough to produce a substantially pencil-shaped antenna beam in a second plane which is substantially perpendicular to the first plane and to the longitudinal axes of the rods when the rods are mounted in columnar array. Mounting means are provided for mounting the rods in columnar array with the longitudinal axes of the rods substantially parallel to each other and to the first plane and with the perturbations of each rod aligned in rows with the corresponding perturbations of the other rods. The mounting means has reflector plate means fabricated of an electrically conductive material which faces a second side of each of the rods which is oppositely-disposed from the first rod side for reflecting electromagnetic wave energy radiated from the second rod side to enhance electromagnetic wave energy radiated from the first rod side. The mounting means also has spacer menas for spacing the second rod side of each of the rods a predetermined distance from the reflector plate means and suppressor plate means which are fabricated of an electrically conductive material and which fare third and fourth sides of each of the rods which are substantially perpendicular to the first and second rod sides for suppressing Faraday rotation of electromagnetic wave energy in each of the rods when a magnetic field is applied along the longitudinal axis of the rod to thereby cause scanning of the antenna beam in the first plane. Means are provided for coupling one end of each of the rods to a source of millimeter wave energy so that each rod is fed substantially in phase with the remaining rods. Means are also provided for simultaneously magnetically biasing all of the rods along the longitudinal axes thereof to cause scanning of the antenna beam in the first plane.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
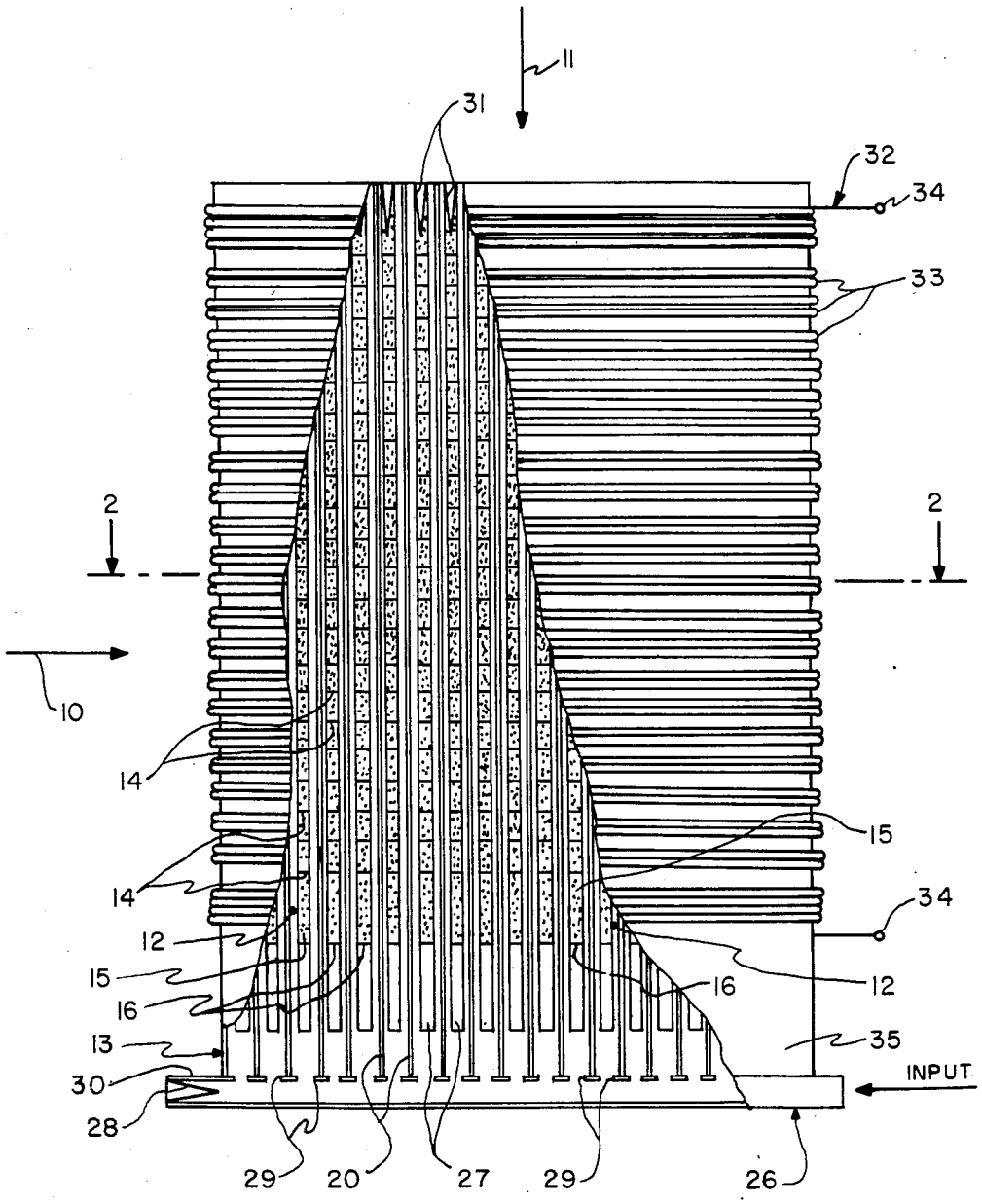
FIG. 1 is a front elevational view of a phase scan antenna array constructed in accordance with the teachings of the present invention with a portion of the cover and the coupling wave guide section broken away to reveal details of construction.
Figure 2:
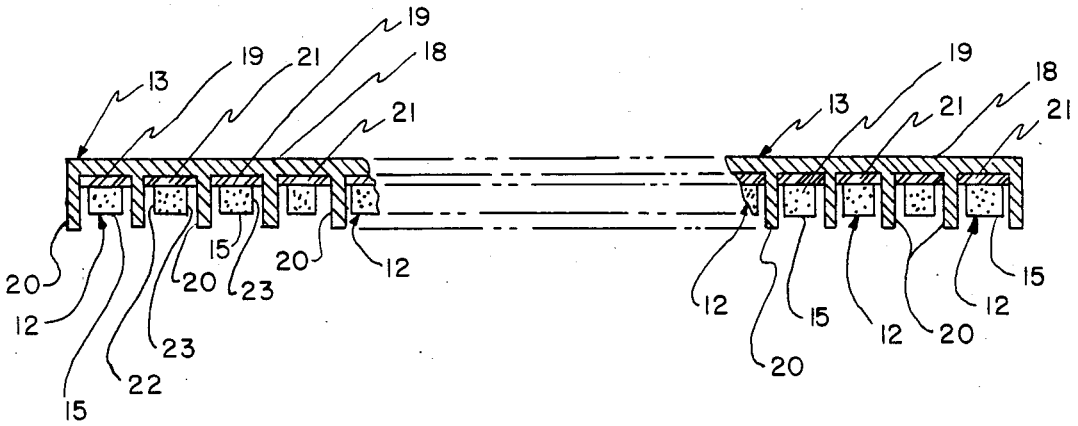
FIG. 2 is a full sectional view of the antenna array of FIG. 1 taken along the line 2—2 of FIG. 1 with the cover and biasing coil means omitted and the sectional view foreshortened for convenience of illustration.

The antenna array of the invention is shown in FIGS. 1 and 2 of the drawings as comprising a plurality of four-sided, ferrite rods, indicated generally as 12, which are mounted in columnar array by mounting means, indicated generally as 13. Each of the rods 12 has a longitudinally-extending series of longitudinally-spaced apart perturbations 14 along a first side 15 of the rod. The perturbations 14 illustrated are narrow slots which are disposed substantially perpendicular to the longitudinal axis of each rod and are adapted to radiate electromagnetic wave energy when the ends 16 of the rods are coupled to a source of millimeter wave energy. The perturbations or slots essentially create irregularities in the length of the rod which cause the energy radiated from each perturbation to be radiated in a direction which is normal to the point of penetration of the perturbation in the rod side. End feed antennas having such perturbations operate on the so-called "leaky-wave" principle as is well known in the art. The ferrite rods may be fabricated of a material having a saturation magnetization greater than 3000 and a dielectric loss tangent less than 0.005, such as nickel zinc or lithium zinc ferrite, for example.

Figure 3:
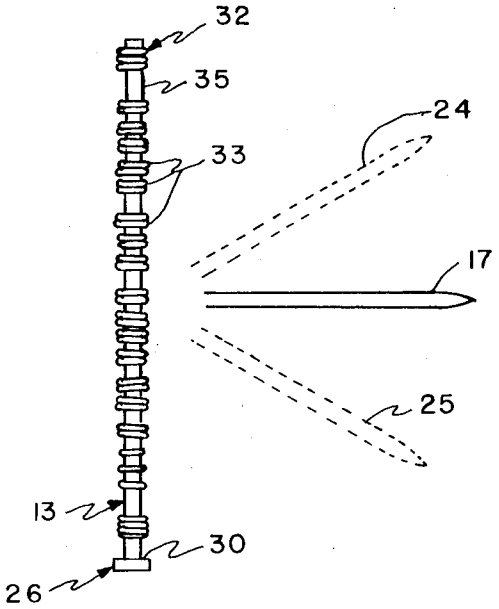
FIG. 3 is a side elevational view of the antenna array taken in the direction of the arrow 10 in FIG. 1 showing the pencil-shaped antenna beam produced by the array in the first or scanning plane and how that beam is swept.

The shape of the antenna beam radiated by each rod in the first or scanning plane is determined by the number, location and spacing of the perturbations 14 of each rod. As the number of perturbations on the rod side is increased, the beam pattern produced by each rod in the scanning plane becomes more compressed so that when the number of perturbations in the series of perturbations becomes large enough, a single substantially pencil-shaped antenna beam 17 will be produced by the array of rods in the first or scanning plane when all of the rods are fed in phase with each other. This beam is shown in FIG. 3 of the drawings. In the front elevational view of the antenna array in FIG. 1 of the drawings, the first or scanning plane of the rods would be normal to the plane of the paper and would extend along the longitudinal axis of the rods.

Figure 4:
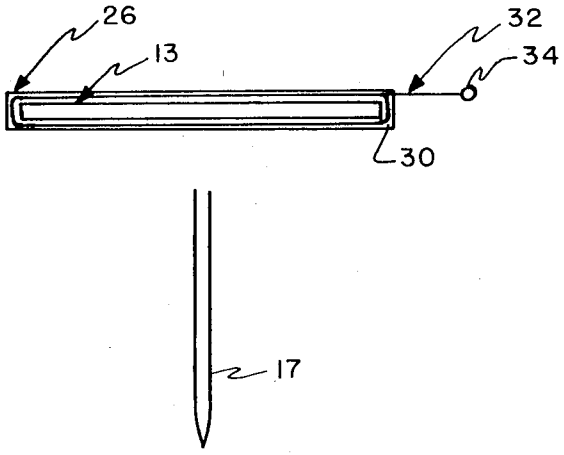
FIG. 4 is a top plan view of the antenna array taken in the direction of the arrow 11 in FIG. 1 showing the pencil-shaped beam in a second plane which is orthogonally related to the first plane.

The shape of the antenna beam produced by each of the rods 12 in a second plane which is substantially perpendicular or orthogonal to the first or scanning plane and to the longitudinal axis of the rod is broad and substantially fan-shaped. However, when a plurality of the rods are mounted in a two-dimensional columnar array by the mounting means 13 with the longitudinal axes of the rods substantially parallel to each other and to the first or scanning plane and with the perturbations 14 of each rod aligned inrows with the corresponding perturbations of the other rods, the shape of the antenna beam produced by the array in the second plane becomes substantially compressed. As the number of rods employed in the columnar array is increased, the more the beam becomes compressed in the second plane with the result that when the number of rods becomes large enough, a single substantailly pencil-shaped beam 17 is produced by the array in the second plane as shown in FIG. 4 of the drawings. Accordingly, the beam 17 produced by the antenna array is a single, substantially pencil-shaped beam when viewed in either the first or the second plane.

As seen in FIGS. 1 and 2 of the drawings, mounting means 13 comprises a reflector plate 18 which should be fabricated of a material which is a good electrical conductor, such as brass, aluminum or silver, for example. The reflector plate 18 is so oriented with respect to each of the rods 12 that it faces a second side 19 of each rod which is oppositely-disposed from the first rod side 15, so that the refelector plate acts as means to reflect electromagnetic wave energy radiated from the second rod side 19 back through the first rod side 15 to thereby enhance the electromagnetic wave energy radiated from the slots 14 on the first rod side 15.

Mounting means 13 also includes a plurality of suppressor plates 20 and a plurality of spacer strips 21. As seen in FIG. 2, the columnarly-disposed suppressor plates 20 project outwardly from the reflector plate 18 and are interleaved between the rods 12, so that each rod is disposed between a pair of the suppressor plates 20. The suppressor plates 20 are also fabricated of a material which is a good electrical conductor, such as brass, aluminum or silver, for example, and face third and fourth sides 22 and 23, respectively, of each of the rods 12. The third and fourth rod sides 22, 23 of each rod are substantially perpendicular to the first and second rod sides 15, 19. The suppressor plates 20 function as suppressor plate means to suppress or prevent the Faraday rotation of electromagnetic wave energy in each of the rods when a magnetic field is applied along the longitudinal axis of the rod. The magnetic field applied along the longitudinal axis of the rod magnetizes the ferrite and causes a change in the electrical length of the rod which, in turn, produces a reciprocal phase shift in the rod. The suppressor plates 20 suppress this Faraday rotation of the wave within the rod and cause the antenna beam radiated from the first rod side to be scanned or swept in the first or scanning plane as shown by the dotted line beam positions 24 and 25 in FIG. 3 of the drawings.

The plurality of spacer strips 21 are columnarly-disposed and are interleaved between the suppressor plates 20. They are also disposed between the reflector plate 18 and the second rod side 19 of each of the rods and have a thickness which is sufficient to make the distance between the second rod side 19 and the reflector plate 18 such that the electromagnetic wave energy reflected from the reflector plate is substantially in phase with the electromagnetic wave energy radiated from the first rod side. This arrangement provides a maximum output for antenna beam radiated and yields a maximum antenna gain. The spacer strips may be made of a low loss, low dielectric constant plastic, such as the thermoset, cross-linked styrene copolymer, "Rexolite 1422", which is marketed by the C-LEC Company of Beverly, N.J., for example. The ferrite rods may be secured to the spacer strips 21 and the spacer strips secured to the reflector plate 18 by suitable means, such as a low loss epoxy adhesive, for example, so that a mechanically rugged support is provided for the rods.

Coupling means comprising a section of hollow, metallic waveguide, indicated generally as 26, and impedance transforming means 27 are provided to couple the ends 16 of the rods to a source of millimeter wave energy, such as the front end of a radar set, for example. The section of waveguide 26 has a rectangular cross section and has its input coupled to the millimeter wave source (not shown) and its output connected to a load 28. The waveguide section extends along the mounting means 13 and columnar array of rods adjacent the ends 16 of the rods and has a series of coupling slots 29 extending along one side 30 of the waveguide section which faces the ends 16 of the rods. The coupling slots are spaced apart a distance substantially equal to one wavelength of the millimeter wave energy from the source and are aligned with the ends 16 of the rods so that each rod is fed by a separate slot.

The impedance transforming means 27 are mounted on the ends 16 of the rods 12 and serve to transform the impedance of the waveguide section to the impedance of the rods for efficient coupling. The impedance transforming means 27 may be fabricated of short, rod-shaped sections of a non-ferrite, dielectric material, such as magnesium titanate, for example, which has a dielectric constant substantially the same as the dielectric constant of the ferrite rods. The free ends of the impedance transforming rods are tapered in a plane which is normal to the plane of the paper bearing FIG. 1 in a manner well-known in the art. The other end of each of the ferrite rods 12 is provided with a load 31 so that when the input to the waveguide section 26 is coupled to a radar set front end, for example, the millimeter wave energy to be transmitted will be coupled through the coupling slots 29 to the rods 12 and will be radiated by the perturbations or slots 14 in each rod. By virtue of the foregoing arrangement, each of the rods 12 is end fed substantially in phase with the remaining rods because the coupling slots 29 are spaced substantially one wavelength apart.

The antenna array beam 17 is scanned or swept in the first or scanning plane by simultaneously magnetically biasing all of the rods 12 in the array along the longitudinal axis of the rods. Biasing coil means, indicated generally as 32, are provided to accomplish this. The biasing coil means 33, each of which is helically wound about the mounting means 13 and columnar array of rods, which extends along the longitudinal axes of the rods. The biasing coils 33 of the series of coils are interleaved between the rows of perturbations 14 to prevent interference with the electromagnetic wave energy radiated from the perturbations. The terminals 34 of the biasing coil means 32 may be connected to an antenna sweep control circuit (not shown) so that as the current in the biasing coils is varied, the antenna beam 17 is swept in the first or scanning plane as shown in FIG. 3 of the drawings. By varying the current applied to the biasing coil means 32, the beam may be swept through an angle which is determined by the design parameters of the antennas making up the array. The same antenna array, of course, will also act to receive incoming electromagnetic wave energy, which in the case of a radar system, is the returning or "echo" signal. The antenna array described has a true reciprocal phase shift action which permits the direction of the beam sweep to be reversed without reversing the polarity of the current in the biasing coil means 32. It will be noted that only a single scanning control winding or "drive" 32 is needed to scan the entire array.

If desired, cover means, such as the cover 35 shown in FIG. 1, may be provided to cover the perturbated or exposed rod sides 15 of the rods in the columnar array. The cover may be secured to the mounting means by any convenient means, such as a "snap-on" arrangement, for example, and may be disposed between the mounting means and the series of baising coils 33 so that the cover and the mounting means are enclosed and surrounded by the biasing coils 33. The cover means should be made of a low loss material which has a low dielectric constant so that there is little attenuation of the radiated or recieved electromagnetic energy through absorption and so that proper impedance matching with the rods is assured. A suitable cover material may be the aforementioned thermoset, cross-linked styrene copolymer, "Rexolite 1422", for example.

Figure 5:
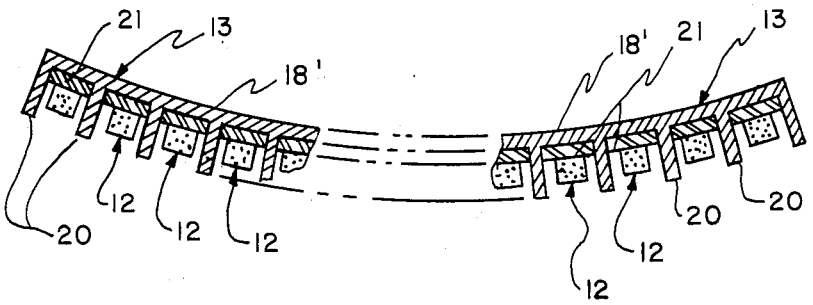
FIG. 5 is a full sectional view similar to the view of FIG. 2 of the mounting means for the antenna array showing how the reflector plate may be curved to provide a conformal antenna array.

A major advantage of the antenna array of the invention is that it is a truly conformal antenna array in that it may be bent or deformed to some degree to meet particular mounting requirements. It will be noted that the reflector plate 18 of the mounting means 13, as thus far described, is a substantially flat plate which is substantially orthogonally-disposed with respect to both the aforementioned first and second planes. However, as shown in FIG. 5 of the drawings, a curved reflector plate 18' may be utilized. The curved reflector plate 18' illustrated in FIG. 5 is essentially a section of a cylindrical surface having the major axis thereof substantially parallel to the longitudinal axes of the rods 12. The curvature of the plate 18' should be relatively "gentle" because, as is apparent from FIG. 5, as the plate curvature is increased, the individual antenna beams produced by each of the rods 12 in the aforementioned second plane tend to diverge so that the single beam produced by the array in the second plane would not be the pencil-shaped beam 17 shown in FIG. 4 of the drawings. In order to remedy the beam divergence caused by the reflector plate curvature, it would be necessary to increase the number of rods in the array to restore the beam to its pencil-shape. Accordingly, there is a "trade-off" between reflector plate curvature and the number of rods which must be used in the array to have a pencil-shaped antenna array beam. Therefore, the degree of curvature should be relatively small in order to keep the overall antenna array size as small as possible.

It is believed apparent that many changes could be made in the construction and described used of the foregoing antenna array and many seemingly different embodiments of the invention could be constructed without departing from the scope thereof. For example, in the mounting means 13 illustrated in the drawings, the reflector plate 18 is shown as having a plurality of mutually-parallel slots formed on one side of the plate in which the rods 12 are disposed so that the suppressor plate 20 are formed by the walls of the reflector plate slots. Although this construction lends itself to easy fabrication by simple slot machining techniques from a single plate, it is apparent that the reflector plate and suppressor plates could be separate elements which are secured together by suitable means. Accordingly, it is intended that all matter contained in the above description or shown in the accompanying drawings shall be interpreted as illustrative and not in a limiting sense.

What is claimed is:

1. A phase scan antenna array for planar radar scanning in a first plane with a substantially pencil-shaped beam comprising a plurality of ferrite rods, each of said rods having a longitudinally-extending series of longitudinally-spaced apart slots along a first side thereof for radiating electromagnetic wave energy when the ends of said rods are coupled to a source of millimeter wave energy, each of said slots being substantially perpendicular to the longitudinal axis of said rod, the slots in said series of slots producing a substantially pencil-shaped antenna beam in said first plane and said rods producing a substantially pencil-shaped antenna beam in a second plane which is substantially perpendicular to said first plane and to the longitudinal axes of said rods when said rods are mounted in columnar array;

means for mounting said rods in columnar array with the longitudinal axes of said rods substantially parallel to each other and to said first plane and with the slots of each rod aligned in rows of slots with the corresponding slots of the other rods, said mounting means having reflector plate means fabricated of an electrically conductive material and facing a second side of each of said rods which is oppositely-disposed from said first rod side for reflecting electromagnetic wave energy radiated from said second rod side to enhance electromagnetic wave energy radiated from said first rod side, spacer means for spacing the second rod side of each of said rods a predetermined distance from said reflector plate means, and suppressor plate means fabricated of an electrically conductive material and facing third and fourth sides of each of said rods which are substantially perpendicular to said first and second rod sides for suppressing Faraday rotation of electromagnetic wave energy in each of said rods when a magnetic field is applied along the longitudinal axis of the rod to thereby cause scanning of the antenna beam in said first plane;

means for coupling one end of each of said rods to a source of millimeter wave energy so that each rod is fed substantially in phase with the remaining rods; and means for simultaneously magnetically biasing all of said rods along the longitudinal axes thereof to cause scanning of the antenna beam in said first plane.

2. A phase scan antenna array as claimed in claim 1 wherein said reflector plate means comprises a reflector plate, said suppressor plate means comprises a plurality of columnarly-disposed suppressor plates projecting outwardly from said reflector plate and interleaved between the rods of said plurality of rods so that each rod is disposed between a pair of said suppressor plates, and said spacer means comprises a plurality of columnarly-disposed spacer strips interleaved between the suppressor plates of said plurality of suppressor plates and disposed between said reflector plate and the second sides of said rods, the thickness of said spacer strips being sufficient to make said predetermined distance such that the electromagnetic wave energy reflected from said reflector plate is substantially in phase with the electromagnetic wave energy radiated from said first rod side.

3. A phase scan antenna array as claimed in claim 2 wherein said biasing means comprises a series of serially-interconnected biasing coils helically wound about said mounting means and columnar array of rods and extending along the longitudinal axes of said rods, the biasing coils of said series of coils being interleaved between said rows of slots to prevent interference with the electromagnetic wave energy radiated from said slots.

4. A phase scan antenna array as claimed in claim 3 wherein said coupling means comprises a section of hollow metallic waveguide extending along said mounting means and columnar array of rods adjacent said one end of said rods, said waveguide section having a series of coupling slots extending along one side thereof facing said one end of said rods, the coupling slots of said series of coupling slots being spaced apart a distance substantially equal to one wavelength of said millimeter wave energy from said source and being aligned with the ends of said rods so that each rod is fed by a separate coupling slot, and impedance transforming means mounted on said one end of each of said rods for transforming the impedance of said waveguide section to the impedance of said rods.

5. A phase scan antenna array as claimed in claim 4 further comprising cover means fabricated of a low loss material having a low dielectric constant for covering the slotted rod sides of the rods in said columnar array of rods, said cover means being mounted on said mounting means and disposed between said mounting means and said series of biasing coils.

6. A phase scan antenna array as claimed in claim 4 wherein said reflector plate is a substantially flat plate which is substantially orthogonally-disposed with respect to both said first and second planes.

7. A phase scan antenna array as claimed in claim 6 wherein said reflector plate has a plurality of mutually parallel slots formed no one side thereof in which said rods are disposed, and said suppressor plates are the walls of said reflector plate slots.

8. A phase scan antenna array as claimed in claim 4 wherein said reflector plate is a section of a cylindrical surface having the major axis thereof substantially parallel to the longitudinal axes of said rods.

* * * * *